US007871027B2

(12) United States Patent
Ko

(10) Patent No.: US 7,871,027 B2
(45) Date of Patent: Jan. 18, 2011

(54) AUTO FEED SHREDDER APPARATUS AND METHODS

(75) Inventor: Joseph Y. Ko, Laguna Niguel, CA (US)

(73) Assignee: Techko, Inc., Irvine, CA (US)

( * ) Notice: Subject to any disclaimer, the term of this patent is extended or adjusted under 35 U.S.C. 154(b) by 393 days.

(21) Appl. No.: 12/030,767

(22) Filed: Feb. 13, 2008

(65) Prior Publication Data

US 2009/0200407 A1 Aug. 13, 2009

(51) Int. Cl.
*B02B 7/02* (2006.01)
*B02C 23/00* (2006.01)

(52) U.S. Cl. ..... 241/100; 241/225; 241/236

(58) Field of Classification Search ..... 241/100, 241/236, 225
See application file for complete search history.

(56) References Cited

U.S. PATENT DOCUMENTS

| | | | | |
|---|---|---|---|---|
| 245,608 | A | | 8/1881 | Burk |
| 3,514,098 | A | | 5/1970 | Ostwald |
| 3,724,766 | A | | 4/1973 | Bosland |
| 3,933,350 | A | | 1/1976 | Mignano |
| 4,192,467 | A | | 3/1980 | Hatanaka |
| 4,200,239 | A | | 4/1980 | Simone et al. |
| 4,815,669 | A | | 3/1989 | Fujii |
| 4,815,670 | A | | 3/1989 | Iwai |
| 4,817,877 | A | | 4/1989 | Itoh et al. |
| 4,842,205 | A | | 6/1989 | Araki et al. |
| 4,893,759 | A | * | 1/1990 | Mizobata ..... 241/100 |
| 4,903,900 | A | | 2/1990 | Rousseau |
| 4,986,481 | A | | 1/1991 | Fujii et al. |
| 5,009,410 | A | | 4/1991 | Fujii et al. |
| 5,020,733 | A | | 6/1991 | Strohmeyer |
| 5,026,042 | A | | 6/1991 | Miller |
| 5,188,301 | A | | 2/1993 | Hasegawa |
| 5,197,608 | A | | 3/1993 | Stangenberg et al. |
| 5,228,673 | A | | 7/1993 | Osonoe |
| 5,354,001 | A | | 10/1994 | Hasegawa |
| 5,362,002 | A | | 11/1994 | Tsai |
| 5,485,991 | A | | 1/1996 | Hirano et al. |
| 5,662,280 | A | | 9/1997 | Nishio et al. |
| 5,695,131 | A | | 12/1997 | Wenzel |
| 5,772,129 | A | | 6/1998 | Nishio et al. |

(Continued)

FOREIGN PATENT DOCUMENTS

| | | |
|---|---|---|
| JP | 03192027 | 8/1991 |

(Continued)

*Primary Examiner*—Bena Miller
(74) *Attorney, Agent, or Firm*—Knobbe, Martens, Olson & Bear LLP

(57) ABSTRACT

Shredding devices and methods are disclosed for automatically feeding multiple sheets of paper to be simultaneously shredded. The shredding devices include an auto feed portion for receiving and advancing the paper to be shredded. Certain examples include a paper feed tray and an auto feed assembly having a rotatable elongated shaft and a plurality of disks disposed thereon. As the elongated shaft rotates, the plurality of disks engages a stack of paper present in the feed tray and advances multiple sheets of the stack of paper to shredding blades. Certain feed trays are further configured to fold into a top portion of the housing during non-use and can advantageously protect the auto feed assembly. Certain shredding devices further include at least one feed slot for receiving material manually fed into the shredding device by the user.

21 Claims, 5 Drawing Sheets

U.S. PATENT DOCUMENTS

| | | | | |
|---|---|---|---|---|
| 5,884,855 | A | 3/1999 | Chang | |
| 5,975,445 | A | 11/1999 | Ko | |
| 6,152,001 | A | 11/2000 | Faustmann | |
| 6,382,620 | B1 | 5/2002 | Gaarder et al. | |
| 6,390,397 | B1 | 5/2002 | Ko | |
| 6,550,701 | B1 * | 4/2003 | Chang | 241/36 |
| 6,554,270 | B2 | 4/2003 | Yamamoto | |
| 6,595,444 | B2 | 7/2003 | Schwelling | |
| 6,651,977 | B2 | 11/2003 | Tanaka | |
| 6,659,449 | B2 | 12/2003 | Kim | |
| 6,719,226 | B2 | 4/2004 | Rajewski | |
| 6,779,747 | B2 | 8/2004 | McLean et al. | |
| 6,918,583 | B2 | 7/2005 | Asada et al. | |
| 7,063,315 | B2 | 6/2006 | Lyu et al. | |
| 7,234,656 | B1 | 6/2007 | Lo | |
| 7,387,268 | B2 | 6/2008 | Dahle et al. | |
| 7,422,171 | B2 | 9/2008 | Huang | |
| 7,490,789 | B2 | 2/2009 | Omi | |
| 7,500,627 | B2 | 3/2009 | Park et al. | |
| 7,658,342 | B2 | 2/2010 | Chang | |
| 7,721,982 | B2 | 5/2010 | Schwelling et al. | |
| 2006/0054727 | A1 | 3/2006 | Ko | |
| 2007/0181721 | A1 | 8/2007 | Ko | |
| 2007/0273079 | A1 | 11/2007 | Omi et al. | |
| 2008/0179436 | A1 | 7/2008 | Kuraoka | |
| 2008/0197220 | A1 | 8/2008 | Tsai | |
| 2009/0014565 | A1 | 1/2009 | Matlin et al. | |

FOREIGN PATENT DOCUMENTS

| | | |
|---|---|---|
| JP | 05092143 | 4/1993 |
| JP | 2004050022 | 2/2004 |

* cited by examiner

AUTO FEED SHREDDER APPARATUS AND METHODS

BACKGROUND

1. Field of the Inventions

Embodiments of the inventions generally relate to shredding machines and, in particular, to apparatus and methods for automatically feeding material to be shredded.

2. Description of the Related Art

Shredding devices are used to aid in recycling and/or to prevent the dissemination of information on paper, compact discs, magnetically striped cards or other media or material. Many conventional shredding devices heretofore available have either been large, expensive machines for use with large quantities of paper or smaller devices for manual, single-sheet feeding by a user. Some shredding devices further allow the user to manually insert a document having up to about ten pages. Oftentimes, such shredding devices are mounted on trash receptacles that are customized for secure attachment of the shredding device.

Smaller, consumer-sized shredding devices typically have limited cutting ability and require manual insertion of a document into the top of the device. Thus, use of these shredding devices can demand significant amounts of time on the part of the user to continually feed paper into the machine. To address this drawback, some consumer-sized shredding devices can automatically feed single pieces of paper sequentially into the device. However, such devices still take long periods of time to shred a substantial amount of paper.

SUMMARY OF THE INVENTIONS

In view of the foregoing, a need exists for shredding devices having an improved automatic feed feature. Moreover, there is a need for shredding devices and methods that shorten the shredding process without requiring continual interaction by the user.

For example, certain embodiments of the inventions include a paper shredding device that provides an automatic feed assembly or mechanism by which a stack of up to about fifty to about five hundred sheets of 20-pound bond paper can be shredded automatically. The automatic feed assembly can advantageously feed multiple sheets of paper to be simultaneously shredded by the device, thereby shortening total shred times and reducing the amount of user interaction required during the shredding process.

In certain embodiments, a consumer-sized shredding device is disclosed for simultaneously cutting multiple sheets of paper. The shredding device comprises a first plurality of shredding rollers and a motor configured to drive the first plurality of shredding rollers to cut a material upon contact with the shredding rollers. The shredding device further comprises a housing substantially enclosing the first plurality of shredding rollers and the motor, the housing being further configured to mount on a waste receptacle, and a feed tray attached to the housing, the feed tray being configured to receive a plurality of sheets of paper. In addition, the shredding device includes an auto feed assembly configured to simultaneously advance multiple sheets of the plurality of sheets of paper from the feed tray to the first plurality of shredding rollers. The auto feed assembly comprises a rotatable elongated shaft and a plurality of disks positioned along the rotatable elongated shaft, each disk having a plurality of spikes disposed around a circumference thereof, the plurality of spikes configured to engage the multiple sheets during rotation of the rotatable elongated shaft. In other embodiments, the housing can be integrated with the waste receptacle.

In certain embodiments, a method is disclosed for manufacturing a consumer-sized shredder capable of automatically feeding paper to be shredded. The method comprises: providing a first plurality of shredding blades; providing a housing substantially enclosing the first plurality of shredding blades; and providing an auto feed portion for automatically advancing multiple sheets of paper to be simultaneously shredded by the first plurality of shredding blades. The auto feed portion further comprises a feed tray attached to a rear portion of the housing, the feed tray being configured to hold a plurality of sheets of paper comprising the multiple sheets, an elongated shaft, and a plurality of engaging members positioned along the elongated shaft, each engaging member being configured to engage the multiple sheets of paper during rotation of the elongated shaft to advance the multiple sheets to the first plurality of shredding blades.

In certain embodiments, a portable consumer-sized shredding device is disclosed. The shredding device includes: means for cutting material; means for receiving a plurality of sheets of paper to be shredded; and means for forwarding multiple sheets of the plurality of sheets of paper from said cutting means to said receiving means. The forwarding means further comprises means for engaging the multiple sheets, and means for rotating said engaging means.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENTS

Embodiments of the invention include devices and methods for automatically feeding material into a shredding device. In particular, certain embodiments include auto feed mechanisms for concurrently advancing multiple sheets of paper into a shredding device. In certain embodiments, such shredding devices provide for a more streamlined shredding process and reduce the amount of time and effort required by a user during the shredding process.

In certain embodiments, shredding devices disclosed herein comprise consumer-sized shredding devices that include an auto feed portion configured to hold a stack of approximately fifty to five hundred sheets (e.g., 200 sheets) of 20-pound paper and to automatically feed multiple sheets of paper from the stack to the shredding blades. The shredding devices can also provide one or more additional feed slots for receiving manually-inserted paper and/or other media.

The features of the systems and methods will now be described with reference to the drawings summarized above. Throughout the drawings, reference numbers are re-used to indicate correspondence between referenced elements. The drawings, associated descriptions, and specific implementation are provided to illustrate embodiments of the inventions and not to limit the scope of the disclosure.

In addition, methods and functions described herein are not limited to any particular sequence, and the acts relating thereto can be performed in other sequences that are appropriate.

The term "media" as used herein is a broad term and is used in its ordinary sense and is used, without limitation, to describe generally planar household and office materials capable of being shredded. Such materials include, but are not limited to, paper, paper with fasteners, compact disks, floppy disks, envelopes, credit cards, cardstock, memory cards and the like.

The term "consumer-sized" as used herein is a broad term and is used in its ordinary sense and is used, without limitation, to describe apparatus, devices, systems, and the like, that are generally used in a home or office setting. For example, a "consumer-sized shredder" refers to a shredder that is generally used in a home or a small office. For instance, a consumer-sized shredder may generally have a smaller shredding capacity than a larger, commercial-sized or industrial-sized shredder.

Figure 1:
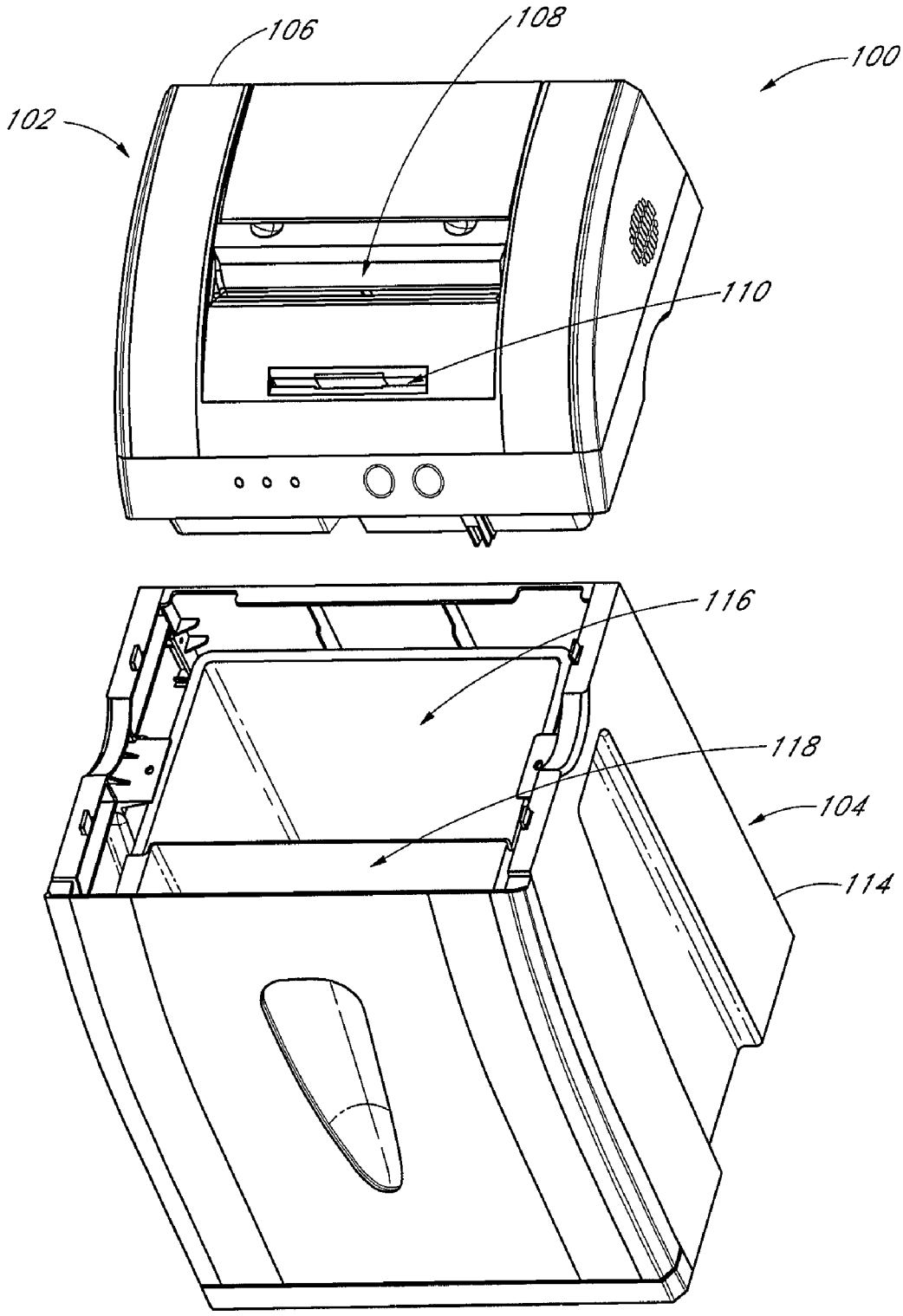
FIG. 1 illustrates a front perspective view of a shredding device, according to certain embodiments of the invention.

FIG. 1 illustrates a front perspective view of a shredding device 100, according to certain embodiments of the invention. As shown, the shredding device 100 includes a shredder portion 102 and a waste portion 104. In certain embodiments, the shredder portion 102 is configured to mount on a top side of the waste portion 104 during operation such that shredded material from the shredder portion 102 is caught by the waste portion 104. In certain preferred embodiments, the center of gravity of the shredder portion 102 is balanced such that the shredder portion 102 can appropriately mount on the top of the waste portion 104 without causing significant unbalance with respect to the waste portion 104.

In other embodiments, the shredder portion 102 can be configured to mount on one or more other types of containers, such as circular and/or rectangular waste receptacles. In such embodiments, the shredder portion 102 can further include a pair of arms (not shown) extendible from the sides of the shredder portion 102 to rest on the top portion of the waste receptacle. In certain embodiments, the arms are positioned such that the front of the shredder portion 102 is sufficiently spaced from a front wall of the waste receptacle to allow the shredded paper and/or media to fall readily into the waste receptacle and allow a user to place material directly into the waste receptacle.

The illustrated shredder portion 102 further comprises a housing 106 with multiple openings for receiving material to be shredded. In particular, the housing 106 includes a paper feed slot 108 for receiving paper manually fed therein by a user. The housing 106 also includes a media feed slot 110 for receiving media to be shredded. For instance, the media feed slot 110 can be advantageously configured to receive one or more of the following: compact disks (CDs), floppy disks, credit cards, memory cards, or the like.

The waste portion 104 further includes an outside housing 114 that encloses a paper receptacle 116 for receiving the shredded portions of paper inserted in the paper feed slot 108. Within the paper receptacle 116 is a smaller media receptacle 118 for receiving shredded portions of media material inserted through the media feed slot 110. In other embodiments, the waste portion 104 can comprise a single receptacle for receiving all shredded material.

Figure 2:
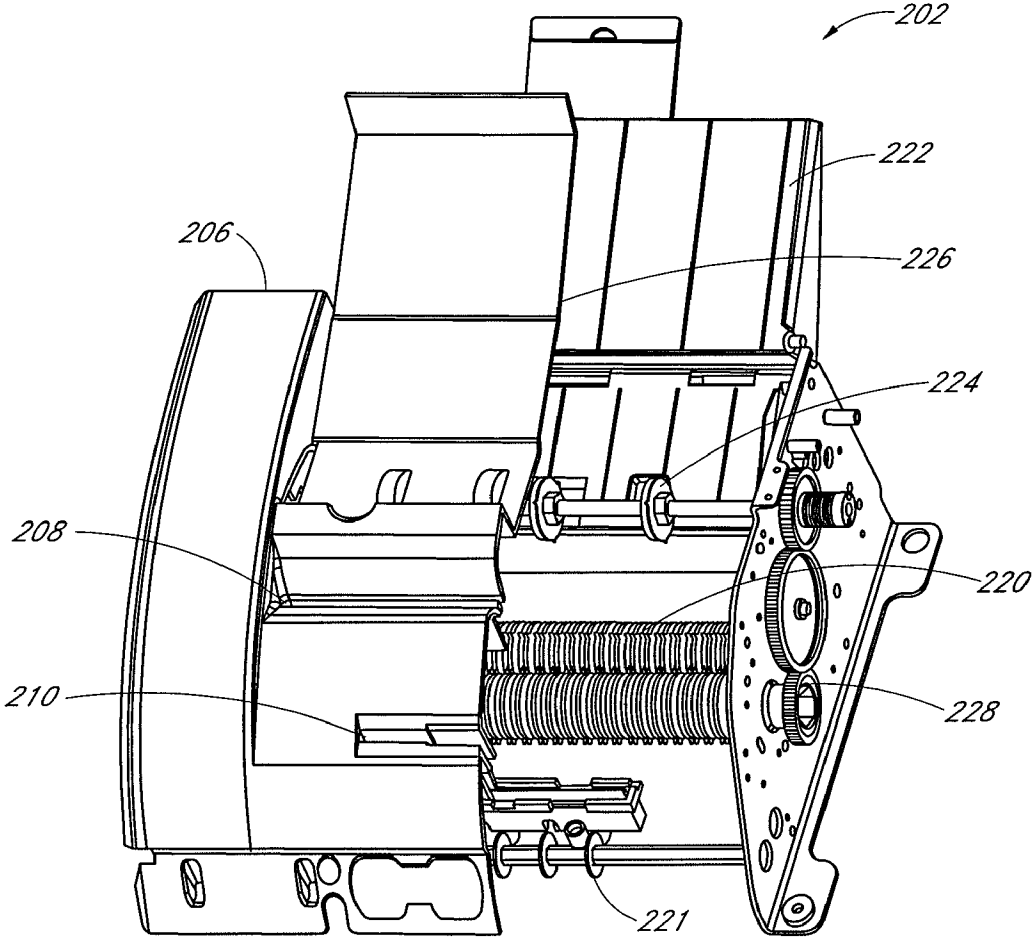
FIG. 2 illustrates a front perspective view of a shredder portion of the shredding device of FIG. 1 with a portion of the housing removed.

FIG. 2 illustrates a front perspective view of an exemplary embodiment of a shredder portion 202 having an auto feed feature. For instance, the shredder portion 202 can have similar features and/or structure as the shredder portion 102 of FIG. 1. For ease of explanation and illustration, a top portion of a housing 206 of the shredder portion 202 has been removed in FIG. 2.

As shown, the shredder portion 202 has a paper feed slot 208 and a media feed slot 210. Positioned below the slots 208 and 210 are, respectively, paper blades 220 and media blades 221. The paper blades 220 are preferably configured to shred paper material into a plurality of pieces. For instance, the paper blades can comprise knife rollers with annular knife edges spaced substantially along the lengths of the rollers. This results in the paper being cut into strips having widths corresponding to the spacing of the annular edges. In other embodiments, knife rollers can be used that have sharpened edges formed thereon in a criss-cross fashion, which results in cross-cutting of the paper into substantially smaller pieces similar to confetti.

In certain embodiments, the paper blades 220 are preferably made of steel or other appropriate material to provide adequate cutting of a plurality of sheets of 20-pound bond paper. For instance, in certain embodiments, the paper blades 220 are configured to cut approximately five to fifteen sheets of paper simultaneously. Moreover, the paper blades 220 can be configured to cut through an occasional staple or other fastener left in the stack of paper, which may comprise one or more stapled, multi-page documents.

The media blades 221 are configured to shred various types of media, as described above. In certain embodiments, the media blades 221 are preferably made of steel or other appropriate material to cut through multiple types of media. Moreover, the media blades 221, in certain embodiments, can be spaced apart, such as by approximately one inch, to facilitate the cutting of non-paper media.

The shredder portion 202 further includes an auto feed feature for automatically feeding multiple pieces of paper to be shredded at the same time. As illustrated, a feed tray 222 is positioned at the rear of the shredder portion 202 and angled to direct paper material to the paper blades 220. Preferably, the feed tray 222 is slightly tilted during use to provide a gravity-assisted feed of paper to be shredded by the paper blades 220.

In certain embodiments, the feed tray 222 is sized to support paper having dimensions ranging from approximately 8.5 inches by eleven inches to approximately 8.5 inches by fourteen inches. In certain embodiments, the feed tray 222 further includes adjustable guides for the feeding of paper having widths ranging between approximately eight to nine inches. In certain embodiments, the feed tray 222 is sized to receive a stack of approximately two hundred sheets of 20-pound bond paper. In yet other embodiments, the feed tray 222 can be configured to hold more or less than two hundred sheets, such as for example, approximately fifty to five hundred sheets. Moreover, if desired, markings (not shown) may be provided on the feed tray 222 and/or its guides to indicate the paper size and approximate height corresponding to a particular number of paper sheets.

In other embodiments, the feed tray 222 can have a plurality of tabs for securing the feed tray 222 to the housing 206 of the shredder portion 202 and for allowing removal of the feed tray 222 during shipping. In yet other embodiments, the feed tray 222 can be secured to the housing 206 using screws or other conventional fasteners.

Positioned near the bottom of the feed tray 222 is an auto feed assembly or mechanism 224 for advancing sheets of paper placed on the feed tray 222. In certain embodiments, the auto feed assembly 224 comprises a plurality of disks for simultaneously advancing multiple sheets of paper to the paper blades 220. In certain embodiments, the auto feed assembly 224 is rotatably coupled to one or more of the paper blades 220, both being driven by an electric motor using a series of gears 228, such that rotation of the auto feed assembly 224 is synchronized with rotation of the paper blades 220.

FIG. 2 also illustrates an upper guide 226 positioned above the feed tray 222. In certain embodiments, the upper guide 226 rests on top of paper placed in the feed tray 222 to prevent the paper from substantial lateral movement and/or to reduce paper movement noise. The upper guide 226 can also advantageously prevent unwanted items from entering the feed tray 222 and/or function as a safety guard (e.g., for preventing children from touching the auto feed assembly 224). In yet other embodiments, the shredder portion 202 can function without the upper guide 226.

Figure 3:
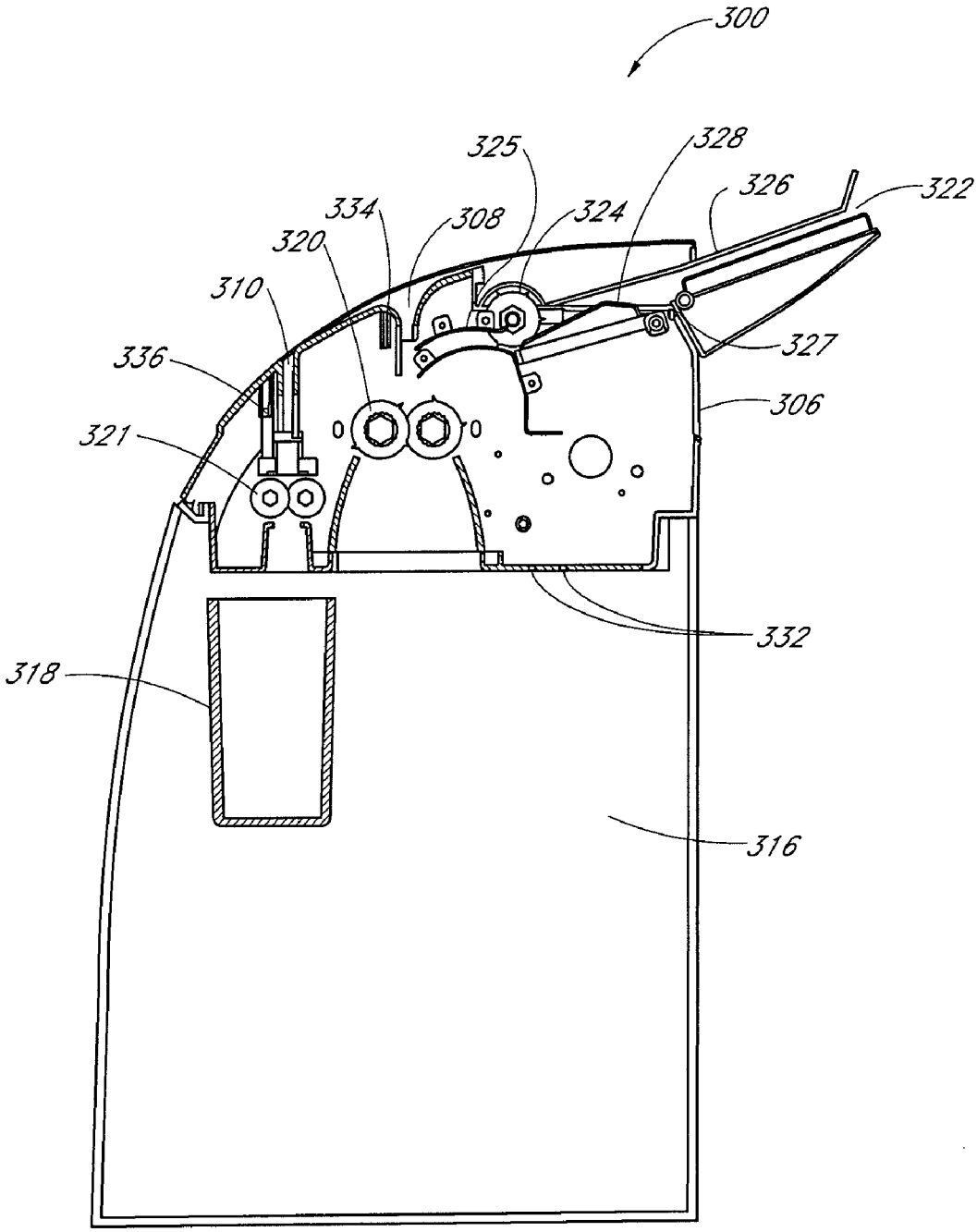
FIG. 3 illustrates a cross-sectional view of the shredding device of FIG. 1.

FIG. 3 illustrates a side cross-sectional view of a shredding device 300, according to certain embodiments of the invention. In certain embodiments, the shredding device 300 can be similar in structure and/or function to the shredding device 100 of FIG. 1 or shredder portion 202 of FIG. 2.

As illustrated, the shredding device 300 comprises a manual paper feed slot 308 and a media feed slot 310 for receiving, respectively, paper material and media material to be shredded. The shredding device 300 further comprises a media receptacle 318 for separating shredded media pieces from shredded paper pieces, which are collected by a paper receptacle 316.

Paper blades 320 are positioned substantially beneath the paper feed slot 308 and are configured to cut paper inserted therein into a plurality of pieces. Likewise, media blades 321 are positioned substantially beneath the media feed slot 310.

The shredding device 300 also comprises an auto feed tray 322 with an upper tray 326 and an auto feed assembly or mechanism 324 for automatically forwarding multiple pieces of paper through a throat 325 into the paper blades 320. As shown, the feed tray 322 is coupled to a shredder housing 306 via a pivot assembly 327 and is advantageously configured to fold into a top portion of the housing 306, such as during transportation and/or non-operation. In such embodiments, the folded feed tray 322 can advantageously protect the auto feed assembly 324 and/or prevent material from entering into the housing 306 except through the paper feed slot 308 or media feed slot 310 (see, for example, the configuration depicted in FIG. 1). In yet other embodiments, the feed tray 322 can slide into the housing 306 or can be secured to the housing 306 using conventional fasteners in a substantially permanent position.

The auto feed portion of the shredding device 300 further includes a lower guide 328 beneath the upper guide 326 and proximate the auto feed assembly 324. In certain embodiments, the lower guide 328 is advantageously configured to push multiple sheets of paper thereon against the auto feed assembly 324. For example, in certain embodiments, the lower guide 328 functions as a spring mechanism that applies upward pressure against the bottom side of a stack of paper within the feed tray 322. As the auto feed assembly 324 rotates, the pressure created by the lower guide 328 facilitates securing and advancing multiple sheets of paper with the auto feed assembly 324. Moreover, adjusting the amount of pressure caused by the lower guide 328 can affect the number of sheets of paper that are simultaneously drawn during rotation of the auto feed assembly 324. In yet other embodiments, other means can be used for creating pressure between the lower guide 328 and the auto feed assembly 324.

The illustrated shredding device 300 also includes a plurality of optional safety features for operating the shredding device 300. In particular, the shredding device 300 comprises at least one sensor 332 for detecting when the paper receptacle 316 reaches a full state. In certain embodiments, multiple sensors 332 are used to verify that a single sensor 332 does not prematurely output a basket full signal.

In addition, a photo sensor 334 and a photo sensor 336 are placed near the throats of, respectively, the manual paper feed slot 308 and the media feed slot 310. The photo sensors 334, 336, in certain embodiments, are configured to automatically activate operation of the respective blades (i.e., paper blades 320 or media blades 321) when detecting material being inserted into the corresponding slots. In yet other embodiments, other types of sensing technology can be used for detecting the insertion of paper and/or media and can include, for example, touch sensors, switches, triggers, or the like.

In certain embodiments, the shredding device 300 can have additional electronic features for improving the safety and functionality of the shredding device 300. For instance, the shredding device 300 can further include an overload detection function that determines when the paper blades 320 and/or media blades 321 are jammed or are otherwise drawing excessive current due to material accumulated therein. Upon detecting an overload, the shredding device 300 can automatically stop rotation of the auto feed assembly 324 and/or the paper blades 320 and media blades 321. In yet other embodiments, the shredding device 300 can reverse the rotation of the paper blades 320 and media blades 321 so as to dislodge material causing the overload condition.

In certain embodiments, the shredding device 300 can further include an overheat detection function that determines when the temperature of the motor has reached a threshold amount. Upon detecting overheating, the shredding device can automatically suspend rotation of the auto feed assembly 324 and/or the paper blades 320 and media blades 321.

In certain embodiments, one or more of the above-disclosed safety functions can be controlled through an integrated circuit (not shown) on the shredding device 300. Moreover, the shredding device 300 can further include a user interface for alerting the user of different shredder conditions. For example, the shredding device 300 can include one or more light emitting diodes (LEDs) or the like for alerting the user of one or more of the following: a basket full indication, a basket door open indication, a motor overheat condition, combinations of the same or the like.

In certain embodiments, to utilize the auto feed feature of the shredding device 300, a user places a stack of paper in the feed tray 322. Because the feed tray is slightly angled toward the shredding device 300, the stack of paper can naturally gravitate toward the auto feed assembly 324. As the auto feed assembly 324 rotates, the auto feed assembly 324 secures multiple sheets of paper from the stack of paper and advances the multiple sheets through the throat 325 to be shredded by the paper blades 320. Once the multiple sheets have been advanced passed the auto feed assembly 324, the auto feed assembly 324 secures and advances a subsequent set of sheets from the stack of paper. This process can continue with the auto feed assembly 324 sequentially securing and advancing multiple sheets of paper until the entire stack of paper has been shredded. As can be seen, interaction by user during the auto feed shredding process is primarily limited to placing the input stack of paper in the feed tray 322.

Figure 4A:
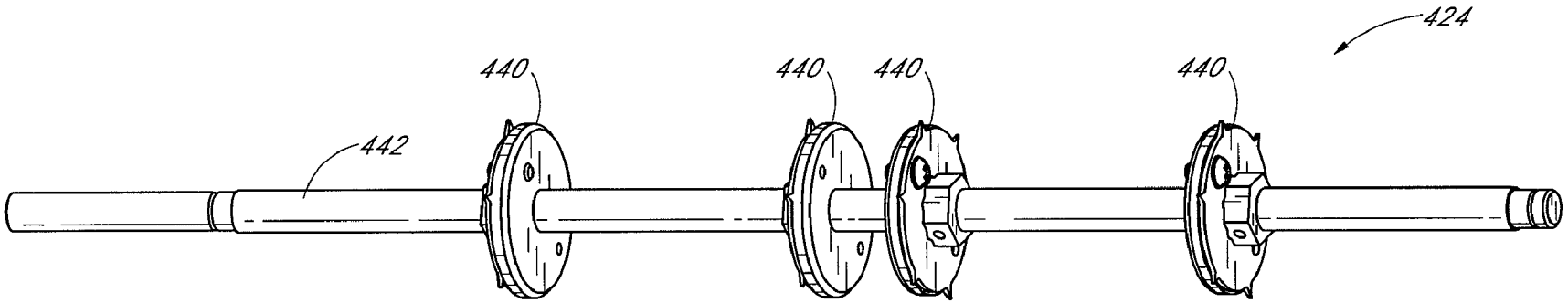
FIG. 4A illustrates a perspective view of an embodiment of an auto feed assembly usable with the shredding device of FIG. 1.

FIG. 4A illustrates a perspective view of an auto feed assembly 424 according to certain embodiments of the invention. The auto feed assembly or mechanism 424 is designed, in certain embodiments, to automatically direct from a stack of paper a plurality of sheets of paper to be simultaneously shredded. For instance, in certain embodiments, the auto feed assembly 424 can be used with any of the shredding devices disclosed herein.

As depicted, the auto feed assembly 424 comprises a rotatable member 442 in the form of an elongated shaft. Disposed along the rotatable member 442 is a plurality of disks 440. During operation, as the rotatable member 442 rotates, the disks 440 advantageously engage multiple sheets of paper at the same time and advance the paper sheets to the shredder blades.

In certain embodiments, the rotatable member 442 is in a fixed position with respect to an auto feed tray for holding the paper to be shredded. In other embodiments, the rotatable member 442 can be automatically adjusted and/or includes a spring-type engagement that allows the disks 440 of the auto feed assembly 424 to rest on and/or place pressure against paper to be shredded. For instance, in certain embodiments, the weight of the auto feed assembly 424 can cause sufficient pressure against the paper in the auto feed tray so as to advance multiple sheets of paper during rotation of the rotatable member 442.

In certain embodiments, the disks 440 are positioned along the rotatable member 442 so as to engage a variety of sizes, widths, or types of paper placed in an auto feed tray. For instance, the illustrated auto feed assembly 424 has four disks 440 positioned with spacing of, from left to right, approximately 2.5 inches, 1 inch (i.e., between the middle two disks 440) and 2.5 inches. In yet other embodiments, other spacing of the disks 440 can be used, and/or the spacing of the disks can be adjusted by the user.

Figure 4B:
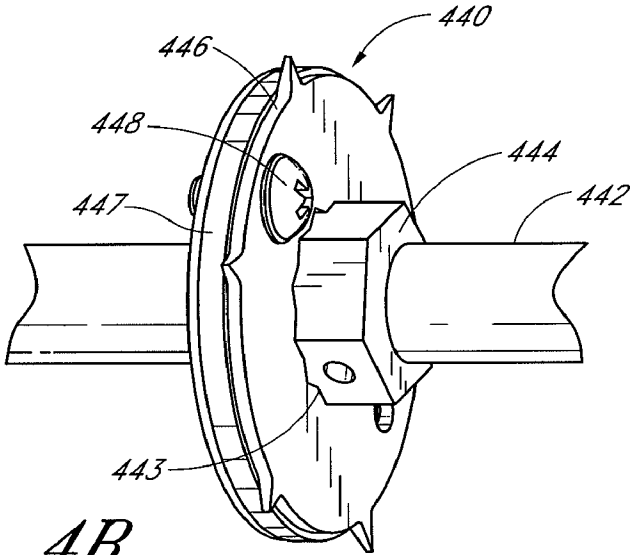
FIG. 4B illustrates a magnified perspective view of an embodiment of a disk of the auto feed assembly of FIG. 4A.

FIG. 4B provides a magnified view of the disk 440, according to certain embodiments of the invention. As illustrated, the disk 440 includes an aperture 443 through which the rotatable member 442 extends. In particular, the aperture 443 is configured to engage a stabilizing nut 444 positioned along the rotatable member 442 to prevent slippage of the disk 440 during rotation of the rotatable member 442.

The disk 440 further includes a substantially circular engaging member 446 secured to a disk body 447 by a screw 448. In certain embodiments, the disk body 447 supports and/or stabilizes the engaging member 446. In certain embodiments, the engaging member 446 and/or disk body 447 have a circumference of between approximately one inch and approximately four inches, such as for example, approximately two inches.

In other embodiments, the auto feed assembly 424 can take on different arrangements than those depicted in FIGS. 4A and 4B. For example, the rotatable member 442 can include a roller design that engages paper and advances multiple sheets to be shredded. In yet other embodiments, the disks 440 can have a substantially different shape, such as, for example, a star or polygonal shape, that engages multiple pieces of paper during rotation.

Figure 5:
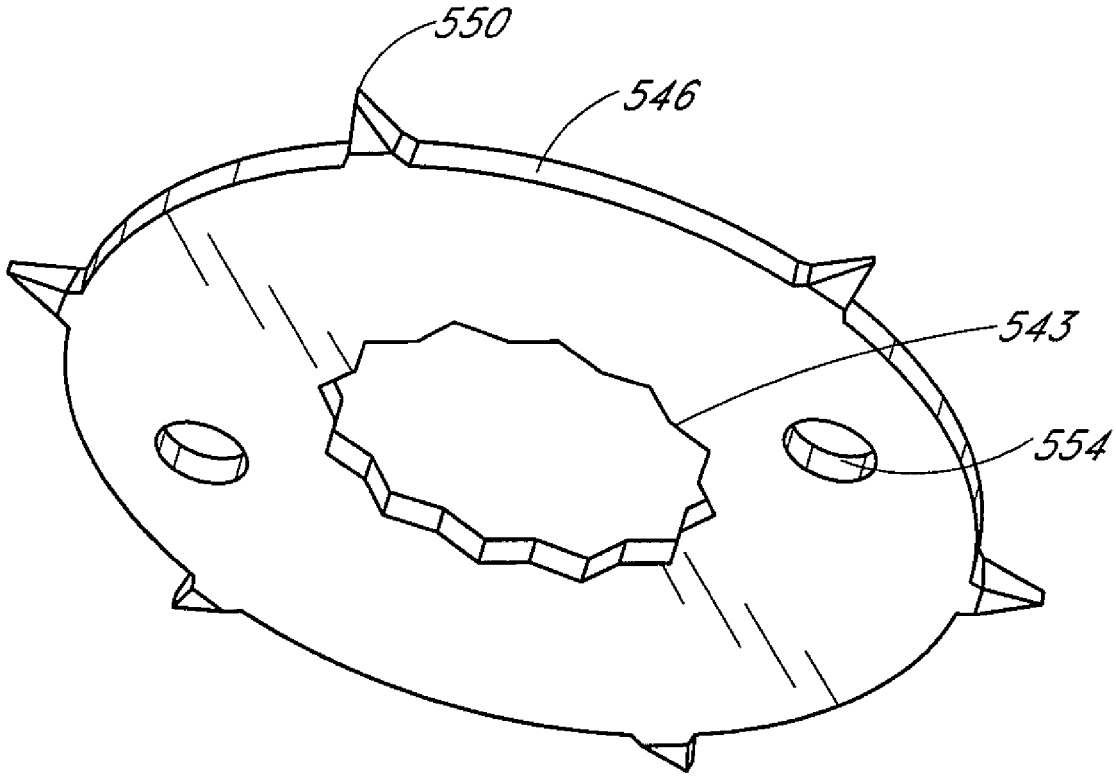
FIG. 5 illustrates an embodiment of an engaging member of the disk of FIG. 4B.

FIG. 5 illustrates an embodiment of an engaging member 546 usable to advance multiple sheets of paper in an auto feed shredder. In certain embodiments, the engaging member 546 can be used with the auto feed assembly 424 depicted in FIGS. 4A and 4B.

As illustrated, the engaging member 546 includes an aperture 543 for receiving a rotatable member therethrough. In certain embodiments, the aperture 543 has a plurality of ridges so as to advantageously prevent unwanted slippage between the engaging member 546 and the rotatable member during rotation.

The engaging member 546 further includes a plurality of spikes or points 550 along a circumference thereof. The points 550 are advantageously sized so as to engage and secure multiple pieces of paper to be advanced to the shredder blades. For instance, the rotatable member can be positioned sufficiently close to a stack of input paper such that, during rotation of the rotatable member, the pressure of the points 550 against the stack of paper secures multiple sheets of paper for simultaneous advancement to the shredder blades. In yet other embodiments, the spikes or points 550 can vary in their spacing around the engaging member 546 and/or can take on different shapes or sizes configured for securing multiple sheets of paper.

In certain embodiments, the points 550 are equally spaced along the circumference of the engaging member 546. In certain embodiments, the points 550 can extend approximately 0.15 inch to approximately 0.35 inch, such as approximately 0.25 inch, from the general circumference or outside edge of the engaging member 546. In yet other embodiments, the points 550 can be sized differently to appropriately accommodate different types of paper and/or to vary the number of sheets simultaneously advanced to the shredding blades. For instance, increasing the size of the points 550 can increase the number of sheets simultaneously advanced in the auto feed process, thereby decreasing total shred times.

As illustrated, the engaging member 546 further includes holes 554 for securing the engaging member 546 to a disk body.

In certain embodiments, shredding devices disclosed herein can include multiple (e.g., three) settings or states, which can be selected by, for example, a three-way switch. For instance, the three settings can include OFF, AUTO and REVERSE for deactivation, automatic operation and reverse operation, respectively.

In certain embodiments, the shredding device can be set to AUTO during normal operation. For the AUTO setting, at least one sensor can detect the presence of at least one sheet of paper on the auto feed tray and/or media inserted into the paper or media slots in order to automatically begin operation of the auto feed feature and/or shredding blades. When paper or other media is no longer detected, the mechanisms are then temporarily deactivated. Preferably, a short delay is provided from the time of the sensor detecting the absence of paper to the deactivation of the mechanisms to allow any last sheets of paper to be shredded and collected by the waste receptacle.

The REVERSE setting allows a user to reverse the operation of the paper blades and/or media blades so as to dislodge unwanted or excess material from the blades. For instance, such a setting advantageously allows the user to better clear out the shredding blades after a paper jam or the like.

In yet other embodiments, the shredding device can include an ON setting that provides for continuous operation of the shredding device. For instance, in the ON setting the auto feed assembly (e.g., the auto feed assembly 224 of FIG. 2) is continuously activated for delivering sheets of paper to be shredded. This setting provides continuous feeding and shredding of papers set onto the feed tray until deactivation occurs by setting the shredding device to OFF.

Embodiments of the invention can be implemented in a wide variety of consumer-sized shedding devices, such as those disclosed in one or more of the following patent and applications: U.S. Pat. No. 6,390,397, issued May 21, 2002; U.S. patent application Ser. No. 11/227,994, filed Sep. 15, 2005, published as U.S. Patent Application Publication No. 2006-0054727 on Mar. 16, 2006; and U.S. patent application Ser. No. 11/594,708, filed Nov. 8, 2006, published as U.S. Patent Application Publication No. 2007-0181721 on Aug. 9, 2007, each of which is hereby incorporated herein by reference in its entirety and is to be considered part of this specification. Moreover, one or more features disclosed herein with reference to one figure or embodiment can be used interchangeably with other disclosed embodiments of the invention.

While certain embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A consumer-sized shredding device for simultaneously cutting multiple sheets of paper, the consumer-sized shredding device comprising:

a first plurality of shredding rollers;

a motor configured to drive the first plurality of shredding rollers to cut a material upon contact with the shredding rollers;

a housing substantially enclosing the first plurality of shredding rollers and the motor, the housing being further configured to mount on a waste receptacle;

a feed tray attached to the housing, the feed tray being configured to receive a plurality of sheets of paper when the feed tray is in an unfolded position, and wherein the feed tray comprises a pivot assembly such that at least a portion of the feed tray is configured to rotate about the pivot assembly to a folded position to prevent receiving the plurality of sheets of paper; and an auto feed assembly configured to simultaneously advance multiple sheets of the plurality of sheets of paper from the feed tray to the first plurality of shredding rollers, the auto feed assembly comprising:

a rotatable elongated shaft, and a plurality of disks positioned along the rotatable elongated shaft, each disk having a plurality of spikes disposed around a circumference thereof, the plurality of spikes configured to engage the multiple sheets during rotation of the rotatable elongated shaft, wherein the feed tray, in the folded position, covers the auto feed assembly to prevent material from entering therein.

2. The consumer-sized shredding device of claim 1, wherein the feed tray is attached to the housing via the pivot assembly such that the feed tray is foldable into a top portion of the housing.

3. The consumer-sized shredding device of claim 1, further comprising an upper guide substantially covering the auto feed assembly and the feed tray.

4. The consumer-sized shredding device of claim 3, wherein the upper guide is further configured to fold with the feed tray while rotating the feed tray about the pivot assembly to the folded position.

5. The consumer-sized shredding device of claim 1, further comprising at least one manual feed opening in a top portion of the housing.

6. The consumer-sized shredding device of claim 5, wherein the feed tray, when in the folded position, does not cover the at least one manual feed opening.

7. The consumer-sized shredding device of claim 5, wherein the at least one manual feed opening comprises a paper feed slot positioned substantially above the first plurality of shredding rollers.

8. The consumer-sized shredding device of claim 7, further comprising a second plurality of shredding rollers configured to shred non-paper media.

9. The consumer-sized shredding device of claim 8, wherein the at least one manual feed opening further comprises a media feed slot positioned substantially above the second plurality of shredding rollers.

10. The consumer-sized shredding device of claim 9, further comprising the waste receptacle.

11. The consumer-sized shredding device of claim 10, wherein the waste receptacle comprises a first compartment for receiving material cut by the first plurality of shredding rollers and a separate second compartment for receiving material cut by the second plurality of shredding rollers.

12. The consumer-sized shredding device of claim 1, wherein the rotatable elongated shaft is rotatably coupled to the first plurality of shredding rollers via a plurality of gears.

13. The consumer-sized shredding device of claim 1, further comprising at least one sensor for detecting the presence of at least one sheet of paper in the feed tray.

14. The consumer-sized shredding device of claim 1, wherein the feed tray is configured to rotate from the unfolded position approximately one hundred eighty degrees (180°) about the pivot assembly to the folded position.

15. The consumer-sized shredding device of claim 1, wherein the feed tray, when in the unfolded position, extends beyond a posterior side of the housing.

16. The consumer-sized shredding device of claim 15, wherein the feed tray is further removably connected to the posterior side of the housing.

17. A portable consumer-sized shredding device comprising:

means for cutting material;

means for receiving a plurality of sheets of paper to be shredded;

means for forwarding multiple sheets of the plurality of sheets of paper at the same time from said cutting means to said receiving means, said forwarding means comprising:

means for engaging the multiple sheets, and means for rotating said engaging means; and means for pivoting at least a portion of said receiving means from an open position for receiving the plurality of sheets of paper to a folded position to prevent receiving the plurality of sheets of paper and to cover said cutting means to prevent material from entering therebetween.

18. The portable consumer-sized shredding device of claim 17, further comprising means for receiving material manually inserted into the consumer-sized shredding device.

19. The portable consumer-sized shredding device of claim 17, wherein said receiving means is configured to pivot approximately one hundred eighty degrees (180°) about said pivoting means from the open position to the folded position.

20. The portable consumer-sized shredding device of claim 17, further comprising second means for cutting non-paper media.

21. The portable consumer-sized shredding device of claim 20, wherein said receiving means, when in the folded position, does not cover said second cutting means.

* * * * *